US007169524B2

(12) United States Patent
Nakamura et al.

(10) Patent No.: US 7,169,524 B2
(45) Date of Patent: Jan. 30, 2007

(54) TONER FOR DEVELOPING ELECTROSTATIC LATENT IMAGE AND IMAGE-FORMING METHOD USING THE SAME

(75) Inventors: Minoru Nakamura, Takarazuka (JP); Yoshihiro Mikuriya, Nishinomiya (JP); Masahide Inoue, Kitakatsuragi-gun (JP); Masahiro Anno, Hachioji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 261 days.

(21) Appl. No.: 10/763,206

(22) Filed: Jan. 26, 2004

(65) Prior Publication Data

US 2004/0265718 A1 Dec. 30, 2004

(30) Foreign Application Priority Data

Jun. 24, 2003 (JP) ..... 2003-179254

(51) Int. Cl.
*G03G 9/08* (2006.01)

(52) U.S. Cl. ..... 430/108.4; 430/108.8; 430/109.4; 430/108.6; 430/108.1

(58) Field of Classification Search ..... 430/111.4, 430/109.3, 109.4, 108.6, 108.1, 108.4, 108.8
See application file for complete search history.

(56) References Cited

U.S. PATENT DOCUMENTS

| | | | | |
|---|---|---|---|---|
| 4,652,509 | A * | 3/1987 | Shirose et al. | 430/108.4 |
| 5,080,995 | A * | 1/1992 | Fox et al. | 430/137.21 |
| 5,518,851 | A | 5/1996 | Katagiri et al. | |
| 5,753,399 | A * | 5/1998 | Hayase et al. | 430/109.4 |
| 6,300,024 | B1 * | 10/2001 | Yusa et al. | 430/109.4 |
| 6,333,131 | B1 | 12/2001 | Ishiyama et al. | |
| 2003/0027066 | A1 * | 2/2003 | Yamashita et al. | 430/109.4 |
| 2003/0190545 | A1 * | 10/2003 | Daimon et al. | 430/109.4 |
| 2004/0142263 | A1 * | 7/2004 | Mikuriya et al. | 430/109.4 |
| 2004/0234878 | A1 * | 11/2004 | Miyazaki et al. | 430/108.4 |

FOREIGN PATENT DOCUMENTS

| | | | |
|---|---|---|---|
| JP | 07-072657 | | 3/1995 |
| JP | 09-022148 | | 1/1997 |
| JP | 11-184142 | | 7/1999 |
| JP | 11-305486 | A | 11/1999 |
| JP | 2001-092174 | | 4/2001 |
| JP | 2001-281910 | | 10/2001 |
| JP | 2002-091084 | A | 3/2002 |
| JP | 2002-107993 | A | 4/2002 |
| JP | 2002-156779 | | 5/2002 |
| JP | 2002-371290 | A | 12/2002 |
| JP | 2003-156881 | A | 5/2003 |
| JP | 2001-100459 | | 4/2004 |

OTHER PUBLICATIONS

CRC Handbook of Chemistry and Physics. Boca Raton: CRC Press. (1985) p. E-194.*
Alger, Mark S. Polymer Science Dictionary. London, Elsevier Applied Science. (1989) p. 185.*

* cited by examiner

*Primary Examiner*—Christopher Rodee
(74) *Attorney, Agent, or Firm*—Buchanan Ingersoll & Rooney PC

(57) ABSTRACT

The present invention provides a toner comprising a binder resin, a colorant and an infrared absorbing agent, wherein tan δ (loss elastic modulus G"/storage elastic modulus G') of the toner at 120° C. is in the range of 3 to 6, and an image-forming method using the toner in which toner images on a recording medium are light irradiated by a flash lamp having a light-emitting energy of 1.0 to 5.0 J/cm$^2$ so that the toner images are fixed on the recording medium.

20 Claims, 1 Drawing Sheet

TONER FOR DEVELOPING ELECTROSTATIC LATENT IMAGE AND IMAGE-FORMING METHOD USING THE SAME

This application is based on application(s) No. 2003-179254 filed in Japan, the contents of which are hereby incorporated by reference.

BACKGROUND OF THE INVENTION

1. Field of the Invention

The present invention relates to a toner used for developing an electrostatic latent image formed by an electrophotographic method, an electrostatic recording method or the like, and more particularly concerns a color toner that is suitable for a non-contact heat fixing system.

2. Description of the Background Art

With respect to the method for heat-fixing a toner image on copying paper, there are basically two methods, that is, a contact heat fixing system and a non-contact heat fixing system. The non-contact heat fixing system is a fixing system in which upon fixing, no members contact an image made from toner powder, and mainly classified into a flash fixing system and an oven (atmosphere) fixing system.

In the flash fixing system, a powder toner image, transferred onto copying paper from a photosensitive member or an intermediate transferring member, is irradiated with flash light from, for example, a xenon lamp, a halogen flash lamp or the like so that the toner image is fused by the radiation heat, and fixed onto the copying paper.

In the oven fixing system, a fine particle toner image, transferred onto copying paper from a photosensitive member or an intermediate transferring member, is irradiated with infrared rays under an oven atmosphere so that the toner image is fused by the radiation heat, and fixed onto the copying paper.

These non-contact heat fixing systems have the following superior features.

Since the powder toner image is fused and fixed-without contacting any members, the toner image is free from damages caused by those members so that upon developing, there is no degradation in the resolution.

Since the fixing time is very short, a high-speed fixing process is available.

Since no waiting time is required for the fixing process, it is possible to start the process quickly.

These systems are readily applied to various kinds of copying paper having different thicknesses and qualities.

However, since the non-contact heat fixing system carries out a heat fixing process in a non-contact state, its ambient energy dissipation is great. From the environmental viewpoint, there have been demands for a reduction in fixing energy. Even under such circumstances, when the total amount of light energy to reach the powder toner image is insufficient, the powder toner image is not sufficiently fused, resulting in the problem of insufficient fixing characteristics. In particular, in the case of a full-color image in which black-color images and color images are simultaneously printed, since the amount of energy to be absorbed is different depending on the respective colors, it is very difficult to control the amount of energy to be applied.

For this reason, in order to achieve a sufficient melt-fixing process, for example, a flash fixing toner having a specific loss elastic modulus at a specific temperature has been proposed (for example JP-A-11-184142 (claim 1)).

However, the above-mentioned toner has failed to provide sufficient color fixing properties depending on types and fixing conditions of images. For example, in the case when the fixing energy is comparatively small, even if desired color reproducibility is obtained in the case of a mono-color image which is formed by a single color, there is degradation in the color reproducibility (degradation in the color-mixing property) when an image having two superposed colors or three superposed colors, such as a full-color image, is fixed. This causes the disadvantage of degradation in smear-preventive property. In other words, in the case when the fixed image is used for a label of a bottle or the like, the image tends to have degradation in the image quality, such as blurring or stains, when rubbed against a packing member or the like, or tends to be transferred onto another member. In the case when copy paper bearing an image formed on at least one surface thereof is fed, the fixed image tends to be rubbed against a roller or the like to cause degradation in the image quality such as blurring or stains; this causes another disadvantage of degradation in smear-preventive property. These problems, in particular, the problem of degradation in the color reproducibility (degradation in the color-mixing property), become more conspicuous as the system speed of an image-forming apparatus is increased.

In order to solve such problems, in particular, the problem of degradation in the color reproducibility, in the case when the fixing energy is increased, although desired image quality is obtained in the case of a mono-color image, a white blank phenomenon occurs upon fixing an image with two superposed colors or three superposed colors having comparatively great amount of toner adhesion, causing image-density irregularities and irregularities in gloss. The white blank phenomenon is an inherent phenomenon in the non-contact heat fixing system in which one portion of a color image appears to be a white blank having a round shape or an elliptical shape. It is considered that the white blank phenomenon is caused by the fact that, when a powder toner image is instantaneously fused excessively, air located between the toner particles appears to the surface of the toner image in a certain collected amount (bumping phenomenon). When the amount of fixing energy is increased, the energy absorption becomes too high in black toner portions to cause a bumping phenomenon in the same manner as the full-color image, resulting in image-density irregularities and irregularities in gloss.

SUMMARY OF THE INVENTION

The object of the present invention is to provide a toner, especially suitable for non-contact heat fixing color developing system, and a full-color image-forming method which form a full-color image that has sufficient color-mixing property in full-color portions with a wider color-reproducing range, by using comparatively small fixing energy. In other words, even in the case of forming an image including solid images, dot images, half-tone images and character images in a mixed manner, an image including black images and color images in a mixed manner and an image including mono-color portions and full-color portions with two-color or three-color superposed portions that have comparatively high amounts of toner adhesion, the toner and the full-color image-forming method of the present invention make it possible to form an image having superior color reproducibility and image quality by using comparatively small fixing energy.

The present invention relates to a toner that comprises a binder resin, a colorant and an infrared absorbing agent, and features that tan δ (loss elastic modulus G"/storage elastic modulus G') of the toner at 120° C. is set in the range of 3 to 6, especially being suitable for non-contact heat fixing color developing system.

The present invention also relates to an image-forming method in which a flash fixing system having flash energy of 1.0 to 5.0 J/cm$^2$ and the above-mentioned toner are used.

DESCRIPTION OF THE PREFERRED EMBODIMENTS

Figure 1:
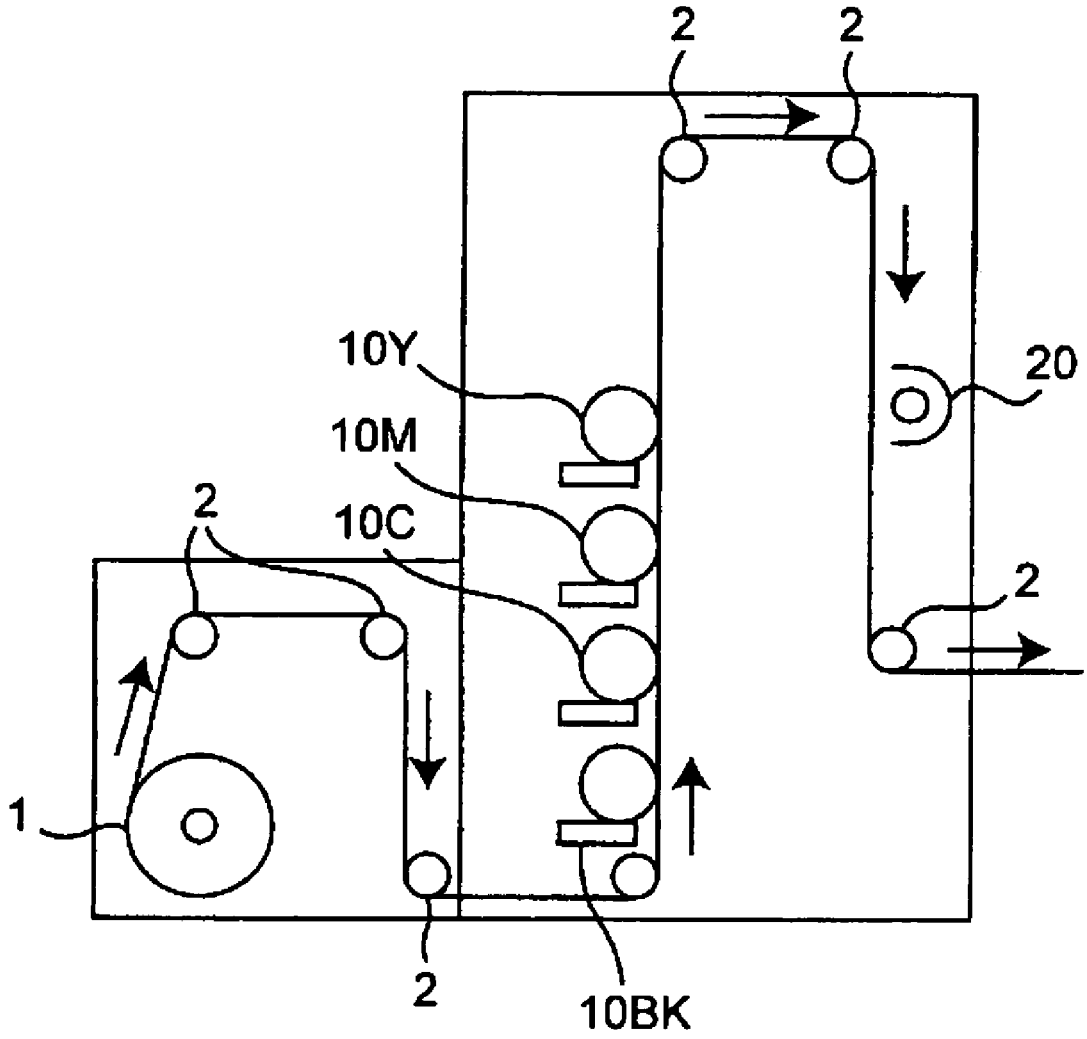
FIG. 1 is a schematic structural drawing showing a full-color image-forming apparatus that suitably uses a toner of the present invention.

In the toner of the present invention, tan δ (loss elastic modulus G"/storage elastic modulus G') of the toner at 120° C. is set in the range of 3 to 6, preferably 3 to 5.5, more preferably 3 to 5, most preferably 3.5 to 5. In the present invention, by allowing the toner to satisfy such dynamic viscoelastic characteristics, heat energy, converted from light energy absorbed by the toner, is effectively utilized so that individual toner particles are appropriately fused. In other words, even when the fixing energy is comparatively small, the individual toner particles are set in an appropriate fused state. For this reason, it becomes possible to achieve both of good color reproducibility (color-mixing property) and good image quality relating to white blanks and the like, and also to improve the smear-preventive property.

In the field of the non-contact heat fixing color toner, the degradation in color reproducibility tends to cause problems when a full-color image having two superposed colors or three superposed colors is fixed. The reasons for this problem are explained as follows: In a mono-color solid image, even when color-toner particles on a recording medium are not fused sufficiently, a great difference in color reproducibility hardly appears virtually; however, in the case of a full color image having two superposed colors or three superposed colors, the toner particles closer to the recording medium fail to exert a sufficient color-mixing property unless at least one portion of the toner particles is fused sufficiently because of the fact that the energy thereof tends to be released to the recording medium and the like, and the resulting degradation in the color-mixing property causes a serious reduction in the color reproducibility; consequently, the resulting full-color image has a narrowed range in the color reproducibility. Such a problem of color reproducibility (color-mixing property) becomes more conspicuous as the system speed of the image-forming apparatus is increased.

As described above, the present invention allows the individual toner particles to have an appropriate fused state even when the fixing energy is comparatively small. For this reason, even in the case of a full-color image having two superposed colors or three superposed colors, it becomes possible to maintain a superior color-mixing property and to achieve superior color reproducibility, without causing problems such as white blanks. Even in the case when toner on a recording medium is in a non-contact state, since the toner is effectively fused, the toner image height is maintained in a low level to make irregularities thereof smaller, thereby improving smoothness. Thus, it becomes possible to improve the degree of gloss.

Tan δ is one index indicating behavior characteristics of a substance, and the smaller the value of tan δ, the greater the tendency of the corresponding substance (toner) to behave elastically; in contrast, the greater the value of tan δ, the greater the tendency of the corresponding substance (toner) to behave with viscosity. When the toner of the present invention has a value of tan δ (loss elastic modulus G"/storage elastic modulus G') at 120° C. of less than 3, the toner has a stronger tendency to elastically store energy upon fixing, failing to achieve a superior color-mixing property in a full-color image, resulting in degradation in the color reproducibility. In contrast, when the value of tan δ at 120° C. exceeds 6, the toner has a stronger tendency to release energy as heat due to viscosity upon fixing so that the toner is fused excessively, causing a white blank phenomenon in an image having great amount of toner adhesion, such as an image having two superposed colors or three superposed colors. It is considered that this phenomenon is caused by the fact that, when a powder toner image is instantaneously fused excessively, a toner flow occurs so that air located between toner particles appears to the surface of the toner image in a certain collected amount to make the corresponding portion thinner in color with a greater difference in color density. The white blank phenomenon hardly occurs in an image having comparatively small amount of toner adhesion, and tends to occur more frequently as the amount of toner adhesion increases. In the case when the amount of toner adhesion is great, the toner image height on a recording medium becomes higher, with the result that the total amount of air existing in a toner image becomes greater; thus, it is considered that the instantaneous fusing tends to easily cause a white blank phenomenon. When the amount of toner adhesion is great to have a high toner image height on a recording medium, the toner particles closer to the medium easily pass energy thereof to the medium; in contrast, the toner particles located farther from the medium is less susceptible to energy transmission to be excessively fused; thus, it is considered that the white blank phenomenon easily occurs.

In the present specification, tan δ (loss elastic modulus G"/storage elastic modulus G') of the toner at 120° C. is measured by using a dynamic viscoelasticity measuring device (Leometer; made by Leology Co., Ltd.) under the following conditions. However, the measuring device is not particularly limited to this device, and any device may be used as long as it allows measurements under the following conditions in accordance with the same principle and rule as the above-mentioned device.

Measuring jig: parallel plate having a diameter of 20 mm
Measuring frequency: 0.1 Hz
Measuring distortion: Max 5%
Measuring temperature: 60 to 180° C.
Measuring rate of temperature rise: 2° C./min
GAP: 1 mm The toner of the present invention preferably has a toner storage elastic modulus G' at 120° C. of not less than $1\times10^2$ (Pa), more preferably $2\times10^2$ (Pa) to $5\times10^3$ (Pa). The storage elastic modulus G' is an index indicating behavior characteristics of a substance, and the greater its value, the greater the tendency of the substance to behave elastically. By allowing the toner to have such characteristics, the toner fluidity is controlled more effectively so that even in the case when the amount of toner adhesion is large, it becomes possible to effectively prevent white blanks.

The storage elastic modulus G' can be measured by the same method as the measuring method of the above-mentioned tan δ.

In the toner of the present invention, its average degree of roundness is set to not less than 0.940, preferably not less than 0.945, so that it is possible to further improve the color reproducibility and the effects of prevention of white blanks. As the average degree of roundness increases, the toner particles are more closely packed onto a recording medium to reduce the influences of air located between the toners in a full-color image having two superposed colors or three superposed colors; thus, it becomes possible to improve the color mixing property, and consequently to improve the color reproducibility upon superposing colors. Since the total amount of air in a toner image is reduced, it is possible to effectively prevent white blanks.

In the present invention, the average degree of roundness is given as the average value of values calculated by the following equation:

$$\text{Average degree of roundness} = \frac{\text{Peripheral length of a circle equal to projection area of a particle}}{\text{Peripheral length of a particle projection image}}$$

where the closer the value to 1, the closer the shape to true circle. In the present invention, the average degree of roundness is indicated by values obtained through measurements carried out by using a flow-type particle image analyzer (FPIA-2000; made by TOA MEDICAL ELECTRONICS CO., LTD.) in an aqueous system. However, the measuring device is not particularly limited to this device, and any device may be used as long as it is capable of carrying out the measurements based upon the above-mentioned equation in principle.

The color toner of the present invention may be composed of any toner components as long as it provides the above-mentioned dynamic viscoelastic characteristics, and may be manufactured by any known method. The volume-average particle size of the toner is set to 4 to 9 μm, preferably 4.5 to 8.5 μm.

The color toner of the present invention contains at least a binder resin, a colorant and an infrared absorbing agent (IR absorbing agent), and also contains, if necessary, other toner components such as wax, a charge-controlling agent, inorganic fine particles, organic fine particles, a grinding assistant and a wax dispersant.

In the present invention, the dynamic viscoelasticity of the toner can be controlled by adjusting the composition and the weight average molecular weight (Mw) of the binder resin. Further, the dynamic viscoelasticity of the toner can also be controlled by adjusting the melting point and the content of the wax. The following description will discuss the toner component and manufacturing method of the color toner of the present invention together with the controlling method of the dynamic viscoelasticity.

With respect to the binder resin of the present invention, examples thereof include polyester resin, styrenic resin and epoxy resin. Preferably, polyester resin and/or styrenic resin is used.

With respect to the polyester resin, a polyester resin, obtained by polycondensating a polyhydric alcohol component and a polycarboxylic acid component, can be used.

Among polyhydric alcohol components, examples of dihydric alcohol components include: bisphenol A alkylene oxide additives, such as polyoxypropylene(2,2)-2,2-bis(4-hydroxyphenyl)propane, polyoxypropylene(3,3)-2,2-bis(4-hydroxyphenyl)propane, polyoxypropylene(6)-2,2-bis(4-hydroxyphenyl)propane, polyoxyethylene(2,0)-2,2-bis(4-hydroxyphenyl)propane, ethyleneglycol, diethyleneglycol, triethyleneglycol, 1,2-propyleneglycol, 1,3-propyleneglycol, 1,4-butanediol, neopentylglycol, 1,4-butenediol, 1,5-pentanediol, 1,6-hexanediol, 1,4-cyclohexanedimethanol, dipropyleneglycol, polyethyleneglycol, polytetramethyleneglycol, bisphenol A and hydrogenized bisphenol A.

Examples of trihydric or more alcohol components include sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane, and 1,3,5-trihydroxymethylbenzene.

Among polycarboxylic acid components, examples of dicarboxylic acid components include maleic acid, fumaric acid, citraconic acid, itaconic acid, glutaconic acid, phthalic acid, isophthalic acid, terephthalic acid, cyclohexanedicarboxylic acid, succinic acid, adipic acid, sebacic acid, azelaic acid, malonic acid, n-dodecenyl succinic acid, isododecenyl succinic acid, n-dodecyl succinic acid, isododecyl succinic acid, n-octenyl succinic acid, isooctenyl succinic acid, n-octyl succinic acid, isooctyl succinic acid, and anhydrides of these acids or low alkyl esters.

Examples of tri- or more carboxylic acid components include 1,2,4-benzenetricarboxylic acid (trimellitic acid), 1,2,5-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl) methane, 1,2,7,8-octanetetracarboxylic acid, pyromellitic acid, enbol trimer acid*, anhydrides of these acids, and low alkyl esters.

In the present invention, among the above-mentioned polyhydroxy alcohol components and polycarboxylic acid components, it is possible to control the dynamic viscoelasticity of the toner by using a polyester resin that uses a monomer having a crystallizing property (crystalline monomer) as a raw-material monomer. In other words, the application of a polyester resin containing a crystalline monomer or an increased content of the crystalline monomer of the polyester resin makes tan δ of the toner smaller, while making G' thereof greater. In contrast, the reduction of the content of the crystalline monomer of the polyester resin makes tan δ of the toner greater, while making G' thereof smaller.

The crystalline monomer is a monomer the application of which can make the degree of crystallinity of the resulting polyester resin higher, and a linear divalent aliphatic or alicyclic saturated monomer is used as such a monomer. The term "linear" in the crystalline monomer refers to the fact that the main chain of a monomer molecule has no carbon-containing group as a side chain. Additionally, the alicyclic monomer serving as the crystalline monomer has an alicyclic portion as one portion of its main chain.

With respect to the alcohol-component crystalline monomer, examples thereof include: ethylene glycol, diethylene glycol, triethylene glycol, 1,3-propylene glycol, 1,4-butanediol, 1,5-pentanediol, 1,6-hexanediol, 1,4-cyclohexanedimethanol, polyethylene glycol, polytetramethylene glycol, 1,3-propane diol, 1,4-cyclohexanediethanol and 1,4-dihydroxycyclohexane.

With respect to the carboxylic-acid-component crystalline monomer, examples thereof include: 1,4-cyclohexane dicarboxylic acid, succinic acid, adipic acid, sebacic acid, azelaic acid, malonic acid, glutaric acid, pimelic acid, suberic acid, 1,4-bis(carboxymethyl) cyclohexane and 1,4-bis(2-carboxyethyl)cyclohexane.

In the present invention, the toner dynamic viscoelasticity can be controlled by adjusting the weight average molecular weight (Mw) of polyester resin. In other words, when Mw of the polyester resin is increased, tan δ of the toner is made smaller, with G' thereof being made greater. In contrast, when Mw of the polyester resin is reduced, tan δ of the toner is made greater, with G' thereof being made smaller.

In the present invention, in an attempt to easily control the dynamic viscoelasticity of the toner, two kinds of polyester resins having different weight-average molecular weights (Mw) are preferably used. More specifically, a first polyester resin having Mw of 7,000 to 30,000, in particular, 8,000 to 25,000, and a second polyester resin having Mw of 30,000 to 250,000, in particular, 40,000 to 250,000, are preferably used. In this case, when the rate of the second polyester resin in the entire polyester resin is increased, tan δ of the toner is made smaller, with G' thereof being made greater. In contrast, when the rate of the second polyester resin is reduced, tan δ of the toner is made greater, with G' thereof being made smaller.

In the case when the first and second polyester resins are used, a crystalline-monomer-containing polyester resin is used as one of the polyester resins, and a crystalline-monomer-free polyester resin is used as the other polyester resin; thus, by adjusting the rates of use of these resins, the dynamic viscoelasticity of the toner can be controlled. In particular, a crystalline-monomer-containing polyester resin is preferably used as the first polyester resin, and a crystalline-monomer-free polyester resin is preferably used as the second polyester resin. This is because by using a crystalline polyester resin as the first polyester resin, it is possible to easily make tan δ of the toner smaller while making G' thereof smaller.

In an attempt to further improve the color reproducibility and smear-preventive property as non-contact heat fixing toner or to control the gloss of an image in color toner requiring transparency, a softening point of the first polyester resin is set to 90 to 120° C., preferably 90 to 110° C., and a softening point of the second polyester resin is set to 120 to 150° C., preferably 120 to 140° C. Further, a glass transition points of the first and second polyester resins are set to 50 to 75° C., preferably 55 to 70° C. This is because when the glass transition point is too low, the heat resistance of the toner becomes insufficient and when it is too high, the grinding property is deteriorated upon manufacturing the toner using a pulverizing method, resulting in low manufacturing efficiency.

With respect to the first polyester resin, a polyester resin obtained by using the following components as main components is preferably used: with respect to the polyhydroxy alcohol component, a bisphenol A alkylene oxide adduct is used while a crystalline monomer (in particular, ethylene glycol) and/or trimethylol propane are added, if necessary; and with respect to the polycarboxylic acid component, at least one kind selected from the group consisting of terephthalic acid, fumaric acid, dodecenyl succinic acid and benzene tricarboxylic acid is used.

With respect to the second polyester resin, a polyester resin obtained by using the following components as main components is preferably used: with respect to the polyhydroxy alcohol component, a bisphenol A alkylene oxide adduct is used as a main component; and with respect to the polycarboxylic acid component, a trivalent or more carboxylic acid component, such as, in particular, at least one kind selected from the group consisting of benzene tricarboxylic acid, terephthalic acid, fumaric acid and dodecenyl succinic acid, is used as a main component.

With respect to the weight ratio between the first polyester resin and the second polyester resin, not particularly limited as long as the toner is allowed to achieve desired dynamic viscoelasticity, and it is normally set to 10:0 to 6:4, preferably 10:0 to 7:3.

With respect to the styrenic resin, the resin made from the following raw-material monomer is used.

Examples of the raw-material monomer for the styrenic resin include: styrene or styrene derivatives, such as styrene, o-methylstyrene, m-methylstyrene, p-methylstyrene, α-methylstyrene, p-ethylstyrene, 2,4-dimethylstyrene, p-tert-butylstyrene and p-chlorostyrene; ethylene unsaturated monoolefins, such as ethylene, propylene, butylene and isobutylene; methacrylic acid alkyl esters, such as methylmethacrylate, n-propylmethacrylate, isopropylmethacrylate, n-butylmethacrylate, isobutylmethacrylate, t-butylmethacrylate, n-pentylmethacrylate, isopentylmethacrylate, neopentylmethacrylate, 3-(methyl)butylmethacrylate, hexylmethacrylate, octylmethacrylate, nonylmethacrylate, decylmethacrylate, undecylmethacrylate and dodecylmethacrylate; acrylic acid alkyl esters, such as methylacrylate, n-propylacrylate, isopropylacrylate, n-butylacrylate, isobutylacrylate, t-butylacrylate, n-pentylacrylate, isopentylacrylate, neopentylacrylate, 3-(methyl)butylacrylate, hexylacrylate, octylacrylate, nonylacrylate, decylacrylate, undecylacrylate, and dodecylacrylate; unsaturated carboxylic acids, such as acrylic acid, methacrylic acid, itaconic acid and maleic acid; acrylonitrile, maleic acid ester, itaconic acid ester, vinyl chloride, vinylacetate, vinylbenzoate, vinylmethylethylketone, vinylhexylketone, vinylmethylether, vinylethylether, and vinylisobutylether. Examples of polymerization initiators used upon polymerizing the material monomers for the styrenic resin include azo or diazo polymerization initiators such as 2,2'-azobis(2,4-dimethylvaleronitrile, 2,2'-azobisisobutyronitrile, 1,1'-azobis(cyclohexane-1-carbonitrile) and 2,2'-azobis-4-methoxy-2,4-dimethylvaleronitrile and peroxide polymerization initiators such as benzoyl peroxide, methylethylketone peroxide, isopropylperoxycarbonate and lauroyl peroxide.

In the case of using styrenic resin also, the toner dynamic viscoelasticity can be controlled by adjusting the weight average molecular weight (Mw) of the resin. In other words, when Mw of the styrenic resin is increased, tan δ of the toner is made smaller, with G' thereof being made greater. In contrast, when Mw of the styrenic resin is reduced, tan δ of the toner is made greater, with G' thereof being made smaller. The weight-average molecular weight (Mw) of the styrenic resin is not particularly limited as long as it allows the toner to achieve desired viscoelasticity, and is normally set to 30,000 to 250,000, preferably 40,000 to 250,000. With respect to the toner manufacturing method upon using the styrenic resin, a polymerization method including a polymerization process, such as an emulsion polymerizing coagulation method, an emulsion polymerization method and a suspension polymerization method, which will be described later, may be used. When such a polymerization method is adopted, the polymerization process is carried out while adjusting Mw, so as to achieve predetermined toner dynamic viscoelasticity.

With respect to the epoxy resin used in the present invention, a polycondensation product between bisphenol A and epichlorohydrin or the like is preferably used. For example, Epomic R362, R364, R365, R367, R369 (made by Mitsui Chemicals), Epotot YD-011, YD-012, YD-014, YD-904, YD-017 (made by Tohto Kasei CO., LTD.) and Epi Coat 1002, 1004, 1007 (made by Shell Oil Co.) are commercially available.

With respect to colorants used in the present invention, known pigments and dyes may be used. Examples thereof include: aniline blue, Chalcooil Blue, chrome yellow, ultramarine blue, DuPont Oil Red, quinoline yellow, methylene blue chloride, copper phthalocyanine, Malachite green oxalate, Lump Black, Rose Bengal, C.I. Pigment Red 48:1, C.I. Pigment Red 122, C.I. Pigment Red 57:1, C.I. Pigment Red 184, C.I. Pigment Yellow 97, C.I. Pigment Yellow 12, C.I. Pigment Yellow 17, C.I. Solvent Yellow 162, C.I. Pigment Yellow 180, C.I. Pigment Yellow 185, C.I. Pigment Blue 15:1, C.I. Pigment Blue 15:3, etc. The amount of addition of these colorants is preferably set in the range of 2 to 10 parts by weight with respect to 100 parts by weight of the binder resin.

With respect to infrared absorbing agents (IR absorbing agents), those pigments known in the field of non-contact heat fixing color toners may be used. Examples thereof include cyanine compounds, polymethine compounds, aminium compounds, diimmonium compounds, phthalocyanine compounds, merrocyanine compounds, benzene-thiol metal complexes, mercaptophenol metal complexes, aromatic diamine metal complexes, nickel complex compounds, anthraquinone compounds and naphthalocyanine compounds. In the present invention, in order to achieve the above-mentioned objective of the present invention, two kinds of compounds having mutually different structural formulas are preferably used in combination. A content of the IR absorbing agent is preferably set to 0.1 to 1 part by weight with respect to 100 parts by weight of the binder resin. In the case of using two or more kinds of IR absorbing agents, the total content of these is set in the above-mentioned range.

The toner of the present invention preferably contains a wax. With respect to the wax, examples thereof include known waxes such as olefin waxes like polyethylene, polypropylene and ethylene-propylene copolymer, synthetic ester waxes like montan esters and aliphatic-acid esters, and carnauba wax, rice wax, sazol wax, Fischer-Tropsch wax, candelilla wax, hydrogenated jojoba oil wax, and paraffin wax; and one kind or two kinds of more of these may be selected and used.

In the present invention, the toner dynamic viscoelasticity may be controlled by adjusting the fusing point and the content of the wax (the total content in the case of using two or more kinds of waxes). In other words, the application of a wax having a higher melting point or a reduced content of the wax makes tan δ of the toner smaller, while making G' thereof greater. In contrast, the application of a wax having a lower melting point or an increased content of the wax makes tan δ of the toner greater, while making G' thereof smaller.

From the viewpoint of easily controlling the dynamic viscoelasticity of the toner, two kinds of waxes having different fusing points are preferably used. More specifically, a first wax having a fusing point of 62 to 95° C., preferably 65 to 90° C., and a second wax having a fusing point of 100 to 150° C., preferably 100 to 140° C., are preferably used. In this case, when the rate of the second wax in the entire wax is increased, tan δ of the toner is made smaller, with G' thereof being made greater. In contrast, when the rate of the second wax is reduced, tan δ of the toner is made greater, with G' thereof being made smaller.

The combination of a synthetic ester wax serving as the first wax and a polyolefin wax serving as the second wax is preferably used.

The content of the wax is not particularly limited as long as the toner achieves desired dynamic viscoelasticity, and is set to 0.5 to 5 parts by weight, preferably 1 to 4.5 parts by weight, with respect to 100 parts by weight of the binder resin. In the case of using two or more kinds of waxes, the total content of these is set in the above-mentioned range.

The toner of the present invention can be manufactured by a known method such as a pulverizing method, an emulsion polymerization method, an emulsion polymerizing coagulation method, a suspension polymerization method and an emulsion dispersion method.

More specifically, in the pulverizing method, after a binder resin, a colorant and an IR absorbing agent as well as other toner components have been mixed, the mixture is melt-kneaded, and then cooled to obtain a kneaded matter. The resulting kneaded matter is pulverized, classified and subjected to a surface-modifying process, if necessary, to obtain toner particles. The IR absorbing agent may be added immediately before the surface-modifying process.

In the emulsion polymerizing coagulation method, a polymerizable composition containing a monomer capable of forming a binder resin (for example, the above-mentioned material monomer of styrene-base resin; hereinafter, referred to as "polymerizable monomer") and the like is emulsion-polymerized in an aqueous dispersion medium, and the resulting resin fine particles are coagulated and fused with at least a colorant in an emulsified state and washed and dried so that toner particles are obtained. The IR absorbing agent, a wax, a charge-controlling agent and the like may be preliminarily contained in the polymerizable composition respectively in separate manner, or may be coagulated and fused with the resin fine particles in an emulsified state together with the colorant.

In the emulsion polymerization method and the suspension polymerization method, a polymerizable composition containing a polymerizable monomer, a colorant and an IR absorbing agent as well as other toner components is emulsified or suspended in an aqueous medium, and polymerized, and then washed and dried to obtain toner particles.

In the emulsion dispersing method, a binder resin, a colorant and an IR absorbing agent as well as other toner components are dissolved or dispersed in an appropriate organic solvent to form a colored resin solution, and the resulting solution is added to an aqueous dispersion medium and stirred strongly to form droplets of the resin solution. Thereafter, this is heated so that the organic solvent is removed from the droplets, and the resulting solution is washed and dried to obtain toner particles.

In the toner of the present invention, it is preferable to externally add a fluidity-adjusting agent to the toner particles obtained by the method as described above. With respect to the fluidity-adjusting agent, inorganic/organic fine particles having an average primary particle size of 5 to 50 nm, preferably 5 to 30 nm, preferably inorganic fine particles, are preferably added. By adding such inorganic/organic fine particles to the toner, it is possible to improve the fluidity of the toner so that the toner particles are closely packed onto a recording medium, and the toner particles are allowed to contact with each other more easily. Since the average primary particle size is maintained in the above-mentioned range, the fine particles are appropriately buried into the surface of each toner particle due to irradiation heat so that the toner particles are mutually made in contact with each other easily. Accordingly, heat is easily conducted so that the toner image is easily fused, thereby making it possible to further improve the color-mixing property. The total amount of air in the toner image is reduced to effectively prevent white blanks. The content of the fluidity-adjusting agent is set to 0.2 to 3 parts by weight, preferably 0.5 to 2 parts by weight, with respect to 100 parts by weight of the toner particles. In the case of using two or more kinds of fluidity-adjusting agents, the total content thereof is set in the above-mentioned range.

With respect to inorganic fine particles, examples thereof include various carbides, such as silicon carbide, boron carbide, titanium carbide, zirconium carbide, hafnium carbide, vanadium carbide, tantalum carbide, niobium carbide, tungsten carbide, chromium carbide, molybdenum carbide, calcium carbide and diamond carbon lactam; various nitrides such as boron nitride, titanium nitride and zirconium nitride; bromides such as zirconium bromide; various oxides, such as titanium oxide, calcium oxide, magnesium oxide, zinc oxide, copper oxide, aluminum oxide, silica and colloidal silica; various titanic acid compounds, such as calcium titanate, magnesium titanate and strontium titanate; sulfides such as molybdenum disulfide; fluorides such as magnesium fluoride and carbon fluoride; various metal soaps, such as aluminum stearate, calcium stearate, zinc stearate and magnesium stearate; and various nonmagnetic inorganic fine particles such as talc and bentonite; and these materials may be used alone or in combination. In particular, in the case of the application of inorganic fine particles such as silica, titanium oxide, alumina and zinc oxide, it is preferable to preliminarily carry out a surface treatment by a known method using a conventionally used hydrophobic-property applying agent, such as a silane coupling agent, a titanate coupling agent, silicone oil and silicone varnish, or using a treatment agent, such as fluorinated silane coupling agents or fluorinated silicone oil, a coupling agent having an amino group and a quaternary aluminum salt group, and a modified silicone oil.

An image-forming method to which the non-contact heat fixing color toner of the present invention is suitably applied is characterized by a fixing system using comparatively low fixing energy. The following description will discuss such an image-forming method by using an image-forming apparatus shown in FIG. 1 that adopts the method. The apparatus shown in FIG. 1 uses a flash fixing system as its fixing system; however, the present invention may use an oven fixing system in which infrared rays are used. More preferably, the flash fixing system is used.

In a full-color image-forming apparatus shown in FIG. 1, a recording medium 1 wound into a roll shape is fed by a feeding roller 2, and on one surface side of the recording medium 1 fed in this manner, a first image-forming unit 10Bk that supplies black toner to the recording medium 1, a second image-forming unit 10C that supplies cyan toner to the recording medium 1, a third image-forming unit 10M that supplies magenta toner to the recording medium 1 and a fourth image-forming unit 10Y that supplies yellow toner to the recording medium 1 are placed in this order from the upstream side of the recording medium 1 toward the downstream side thereof.

The first to fourth image-forming units 10Bk, 10C, 10M and 10Y supply the respective toners to appropriate places so that a full-color toner image is continuously formed on the one surface side of the recording medium 1 that is fed by the feeding roller 2 as described above.

Then, the recording medium 1 on which the full-color toner image has been continuously formed on its one surface side is directed to a flash fixing device 20 provided with a flash lamp by using a feeding roller 2 so that the full-color toner image formed on the one surface side of the recording medium 1 is irradiated with light from this flash fixing device 20 in a non-contact state so that the full-color toner image is fixed on the recording medium 1 by this light energy.

The flash lamp may be a xenon lamp, a halogen lamp or the like. More preferably, a flash lamp having a light-emission spectrum peak at least in a wavelength range from 810 to 840 nm, in particular, such a xenon lamp, is used. In the present invention, even when the light-emitting energy (fixing energy) of the flash lamp is a comparatively small value, in particular, in the range of 1 to 5 J/cm$^2$, it is possible to achieve superior color reproducibility in a full-color image. For this reason, it becomes possible to achieve excellent color reproducibility without causing image noise such as white blanks. Moreover, since the fixing energy is comparatively small, it is possible to prevent excessive energy absorption in black toner portions, and consequently to avoid the occurrence of a bumping phenomenon.

Although not particularly limited, the system speed of the image-forming apparatus of the present invention can be set to a high speed of 90 mm/sec or more, in particular 150 to 300 mm/sec; and even in such a high speed, it is possible to achieve superior color reproducibility without causing problems in image quality such as white blanks and a reduction in the smear-preventive property.

An amount of adhesion of a single color toner is not particularly limited; and in the case when toner layers having a plurality of colors are superposed in the present invention, even if the total amount of adhesion is set to a comparatively great value such as 4 to 6 g/m$^2$, in particular, 4.5 to 5.5 g/m$^2$, it is possible to achieve superior color reproducibility without causing problems in image quality such as white blanks and a reduction in the smear-preventive property.

Even under severe image-forming conditions in which a continuous recording medium such as roll-shaped recording paper is used as the recording medium, as in the case of the above-mentioned image-recording apparatus, it is possible to achieve superior color reproducibility without causing problems in image quality such as white blanks and a reduction in the smear-preventive property.

In the second to fourth image-forming units 10C, 10M, 10Y in the above-mentioned image-forming apparatus, a mono-component developing agent or a two-component developing agent, which contains the color toner of the present invention, is stored.

Black toner, which forms the mono-component developing agent or the two-component developing agent housed in the first image-forming unit 10Bk, is not particularly limited. The black toner may be the same toner as the color toner of the present invention except that carbon black is used as the colorant and that the IR absorbing agent is not used, or may be any known toner in the field of the electrostatic latent image-developing toner.

EXAMPLES (Production Example of Polyester Resin)

To a four-necked flask provided with a thermometer, a stainless stirring stick, a dropping-type condenser and a nitrogen gas directing tube were loaded an alcohol component and an acid component, which were adjusted to a mole ratio as shown in Table 1, together with a polymerization initiator (dibutyltinoxide). This was allowed to react in a mantle heater by heating at 220° C. while being stirred under a nitrogen gas flow. The progress of the reaction was followed by measuring its acid value. At the time of reaching a predetermined acid value, the reaction was completed, and this was cooled to room temperature; thus, polyester resins A1 to A5 were obtained. The physical properties of the resulting polyester resins are shown in Table 2. Each polyester resin was coarsely pulverized into not more than 1 mm, and this was used in manufacturing toners which are described below. Moreover, when two or more resins are mused, these resins are preliminarily mixed at a predetermined ratio, and used. In the Table, BPA-PO represents polyoxypropylene(2,2)-2,2-bis(4-hydroxyphenyl)propane, BPA-EO represents polyoxyethylene (2,0)-2,2-bis(4-hydroxyphenyl)propane, GL represents glycerin, EG represents ethylene glycol, CHDM represents 1,4-cyclohexane dimethanol, TMP represents trimethylol propane, TPA represents terephthalic acid, IPA represents isophthalic acid, CHDA represents cyclohexane dicarboxylic acid, TMA represents trimellitic acid, DSA represents isododecenyl succinic anhydride and FA represents fumaric acid.

TABLE 1

| Polyester resin | Alcohol Component BPA-PO | BPA-EO | GL | EG | CHDM | TMP | Acid Component TPA | IPA | CHDA | TMA | DSA | FA |
|---|---|---|---|---|---|---|---|---|---|---|---|---|
| Resin A1 | 570 | 330 | — | — | — | — | 100 | — | — | — | — | 100 |
| Resin A2 | 350 | 400 | — | — | — | — | 150 | — | — | 100 | 50 | 50 |
| Resin A3 | — | 30 | — | 65 | — | 5 | 100 | — | — | — | — | — |
| Resin A4 | — | 30 | — | 70 | — | — | 100 | — | — | — | — | — |
| Resin A5 | — | — | — | — | 40 | — | 35 | 45 | 20 | 5 | — | — |

TABLE 2

| Polyester Resin | Mn | Mw | Mw/Mn | Tg(° C.) | Tm(° C.) | Acid Value (KOH mg/g) | Hydroxyl Value (KOH mg/g) |
|---|---|---|---|---|---|---|---|
| Resin A1 | 3800 | 11400 | 3.0 | 60.1 | 99.2 | 15.9 | 22.2 |
| Resin A2 | 4200 | 128500 | 30.6 | 65.1 | 135.3 | 14.6 | 15.6 |
| Resin A3 | 3600 | 9500 | 2.6 | 61.2 | 99.6 | 15.3 | 25.3 |
| Resin A4 | 3200 | 6100 | 1.9 | 61.5 | 95.8 | 12.2 | 19.3 |
| Resin A5 | 4500 | 9300 | 2.1 | 62.0 | 103.5 | 17.3 | 23.0 |

(Production Example of IR Absorbing Agent)

IR Absorbing Agent B1 (Cyanine Compound)

To a solvent of 10 parts of acetic anhydride were added 2 parts of 5-methoxy-1-ethyl-3,3-dimethyl-2-methylene indoline (formula (b1)), 1 part of 2-chloro-1-formyl-3-hydroxymethylenecyclohexene (formula (b2)), 1 part of tetrafluoroboric acid and 0.5 parts of sodium acetic anhydride, and after having been boiled for 1 hour, this was cooled to room temperature, and the reaction solution was suction-filtered. The reaction solution was put into 30 parts of water with ice, and the precipitated crystal was suction-filtered. The crystal was washed with 20 parts of methanol, and dried to obtain an IR absorbing agent B1.

(b1)

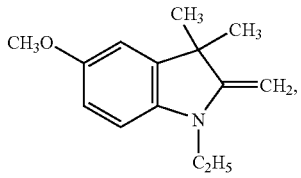

(b2)

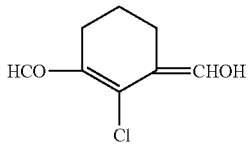

IR Absorbing Agent B2

The same processes as those in the production method of IR absorbing agent B1 were carried out except that a compound of formula (b3) was used in place of the compound of formula (b1) and a compound of formula (b4) was used in place of the compound of formula (b2), with perchloric acid being used in place of tetrafluoroboric acid, so that an IR absorbing agent B2 was obtained.

(b3)

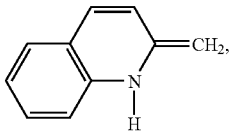

(b4)

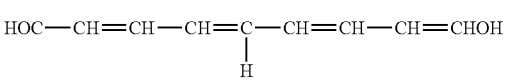

IR Absorbing Agent B3

The same processes as those in the production method of IR absorbing agent B1 were carried out except that a compound of formula (b5) was used in place of the compound of formula (b1) and a compound of formula (b6) was used in place of the compound of formula (b2), with perchloric acid being used in place of tetrafluoroboric acid, so that an IR absorbing agent B3 was obtained.

(b5)

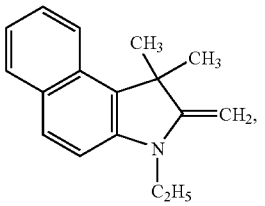

(b6)

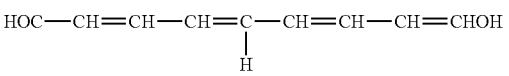

IR Absorbing Agent C1 (Aluminum Compound)

To ethyl acetate was dissolved 1.38 g of N,N,N',N'-tetracis(p-dibutylaminophenyl)-p-penylenediamine, and to this was added a solution prepared by dissolving 6 ml of acetonitrile, 0.22 g of sodium perchlorate and 1.13 g of ammonium salt of ferric complex salt of 1,3-diaminopropane tetraacetate in 6 ml of water. This was stirred for 6 hours at 30° C. The reaction mixture was washed with water, and condensed under reduced pressure, and to this was added n-heptane so that the deposited crystal was filtered and dried to obtain green powder.

(Production Example of Wax)

Wax D1 (Ester Wax)

To a four-necked flask were added 100 g of pentaerythritol serving as alcohol and 1050 g of behenic acid serving as carboxylic acid, and this was allowed to react at normal pressure for 15 hours while distilling the reaction water off at 220° C. The amount of the resulting esterified coarse product was approximately 850 g. To 850 g of the esterified coarse product were added 190 g of toluene and 90 g of ethanol (20 parts by weight of hydrocarbon solvent and 10 parts by weight of separation-use alcohol solvent with respect to 100 parts by weight of esterified coarse product), and to this was further added a 10% aqueous solution of potassium hydroxide and stirred for 30 minutes at 70° C. Thereafter, this was allowed to stand still for 30 minutes and the water-layer portion was removed to complete the deoxidizing process. Next, 20 parts by weight of ion exchange water was added to 100 parts by weight of the esterified coarse product thus used, and after having been stirred for 30 minutes at 70° C., this was allowed to stand still for 30 minutes so that the water layer portion was separated and removed. Washing processes were repeated until the pH of the waste water had become neutral, and with respect to the remaining ester layer, the solvent was distilled off at 180° C. under reduced pressure of 1 kPa, and filtered to obtain an ester wax having a melting point of 84° C.

Wax D2 (Ester Wax)

The same processes as those in the manufacturing method of wax D1 were carried out except that 100 g of dipentaerythritol was used as the alcohol component and that 800 g of palmitic acid was used as the carboxylic acid component to obtain wax. D2 having a melting point of 72° C.

Wax D3 (Ester Wax)

The same processes as those in the manufacturing method of wax D1 were carried out except that 400 g of stearyl alcohol was used as the alcohol component and that 430 g of stearic acid was used as the carboxylic acid component to obtain wax D3 having a melting point of 60° C.

Wax E1 (Polyethylene Wax)

A commercially available low-molecular-weight polyethylene wax (800P: melting point 125° C., made by Mitsui Chemicals Ltd.) was used.

Wax E2 (Polyolefin Copolymer Wax)

To a reactor were measured and charged 1,000 g of propane, 250 g of propene, 0.5 bar of hydrogen and 7 bar of ethylene at 30° C. Simultaneously with these processes, in order to prepare a catalyst, 10 mg of bis-n-butylcyclopentadienyl zirconium dichloride was dissolved a methylaminohexane solution having a concentration of 10% by weight in 5 $cm^3$ of toluene, and this was allowed to stand still for 15 minutes to be preliminarily activated. This reactor was heated to 70° C., and stirred at 100 rpm. After a lapse of 20 minutes, the catalyst that had been preliminarily activated was added through a pressure controllable valve so that a polymerizing process was initiated at 250 rpm. This was cooled so that the polymerization temperature was adjusted to 70° C., and components were measured and further added thereto so that the composition in the gaseous phase was maintained constant. After one hour of the polymerization time, isopropanol was added thereto to stop the reaction, and the reactor was released to air. The resulting product was pressure-reduced and dried to obtain an ethylene-propylene copolymer having a melting point of 105° C.

(Production of Pigment Master Batch)

Each pigment is dispersed in a binder resin and used as a pigment master batch. The binder resin, used in each of examples or comparative examples, and a pigment, such as magenta (M) pigment (C.I. Pigment Red 57-1; made by Fuji Shikiso K.K.), cyan (C) pigment (C.I. Pigment Blue 15-3; made by Dainippon Chemicals and Ink Co., Ltd.) or yellow (Y) pigment (C.I. Pigment Yellow 180; made by Crarient Co., Ltd.), were loaded into a pressure kneader at a weight ratio of 7:3, and kneaded for 1 hour at 120° C. After having been cooled, this was pulverized with a hammer mill to obtain a pigment master batch.

(Production of Color Toner)

Examples 1 to 13 and Comparative Examples 1 to 5

(Pulverizing Method)

Binder resin A, IR absorbing agent B, IR absorbing agent C, wax D and wax E, shown in Tables 3 and 4, were used at respective amounts of use shown in Tables 3 and 4, and master batch virtually containing 4.0 parts by weight of M pigment, master batch virtually containing 5.0 parts by weight of C pigment or master batch virtually containing 7.0 parts by weight of Y pigment was used. After a mixture of these had been sufficiently mixed by Henschel mixer, the resulting mixture was melt-kneaded by using a twin-screw extruder kneader (PCM-63 made by Ikegai Corporation). The resulting kneaded matter was rolled by a cooling press, and cooled off by using a cooling belt, and then coarsely pulverized by a feather mill. Thereafter, the resulting matter was pulverized by using a mechanical grinding device (KTM: made by Kawasaki Heavy Industries, Ltd.) to an average particle size of 10 to 12 μm, and further pulverized and coarsely classified by a jet mill (IDS: made by Nippon Pneumatic Mfg. Co., Ltd.) to an average particle size of 7 μm, and then finely pulverized and classified by a rotor-type classifier (Teeplex-type classifier 100ATP: made by HOSOKAWA MICRON CORPORATION) to obtain toner particles having a volume-average particle size of 7.5 μm.

To 100 parts by weight of these toner particles were added 0.5 parts by weight of hydrophobic silica fine particles having an average primary particle size of 10 nm (H-2000: made by Wacker Co., Ltd.), 0.5 parts by weight of titanium oxide having an average primary particle size of 15 nm (STT30A: made by Titan Kogyo K.K.) and 1.0 part by weight of strontium titanate having an average primary particle size of 0.2 μm, and the mixture of these was mixed by Henschel mixer at a peripheral speed of 40 m/sec for 5 minutes, and then filtered through a sieve of 106 μm mesh to obtain a toner.

Example 14

Emulsion Polymerizing Coagulation Method

To 10.0 L of pure water was put 0.9 kg of sodium n-dodecyl sulfate, and stirred and dissolved. To this solution were gradually added 1.20 kg of C.I. Pigment Red 57-1 (made by Fuji Shikiso K.K.) and 0.1 kg of IR absorbing agent B1, and after having been stirred sufficiently for one hour, this was continuously dispersed for 20 hours by using a sand grinder (medium-type disperser). This solution was prepared as "colorant dispersion solution 1."

Moreover, a solution made from 0.055 kg of sodium dodecylbenzene sulfonate and 4.0 L of ion exchange water was prepared as "anionic surfactant solution A." A solution made from 0.014 kg of nonylphenol polyethylene oxide 10-mol adduct and 4.0 L of ion exchange water was prepared as "nonionic surfactant solution B." A solution formed by dissolving 223.8 g of potassium persulfate in 12.0 L of ion exchange water was prepared as "initiator solution C."

To a 100-L GL (glass lining) reactor equipped with a temperature sensor, a cooling tube and a nitrogen introducing device were loaded 3.41 kg of WAX emulsion (polypropylene emulsion having a number-average molecular weight of 3,000: number-average primary particle size=120 nm/solid concentration=29.9%), all the amount of "anionic surfactant solution A" and all the amount of "nonionic surfactant solution B", and the stirring process thereof was started. Next, to this was added 44.0 L of ion exchange water. The heating process was started, and when the temperature of the solution had reached 75° C., all the amount of "initiator solution C" was dripped thereto. Thereafter, while the temperature of the solution was controlled within 75° C.±1° C., to this were added 12.1 kg of styrene, 2.88 kg of n-butyl acrylate, 1.04 kg of methacrylic acid and 548 g of t-dodecyl mercaptan while being dripped. Upon completion of the dripping process, the temperature of the solution was raised to 80° C.±1° C., and this was heated and stirred for 6 hours. Next, the solution was cooled to not more than 40° C. at which the stirring process was stopped, and filtered through a pole filter; thus, the resulting matter was prepared as "latex A." The resin particle in latex A had a glass transition temperature of 57° C. and a softening point of 121° C., and with respect to the molecular weight distribution, it had a weight average molecular weight=12,700, with a weight-average particle size of 120 nm.

A solution formed by dissolving 0.055 kg of sodium dodecylbenzene sulfonate in 4.0 L of ion exchange water was prepared as "anionic surfactant solution D." A solution formed by dissolving 0.014 kg of nonylphenol polyethylene oxide 10-mol adduct in 4.0 L of ion exchange water was prepared as "nonionic surfactant solution E."A solution formed by dissolving 200.7 g of potassium persulfate in 12.0 L of ion exchange water was prepared as "initiator solution F."

To a 100-L GL reactor equipped with a temperature sensor, a cooling tube, a nitrogen introducing device and a comb-shaped baffle were loaded 3.41 kg of WAX emulsion (polypropylene emulsion having a number-average molecular weight of 3,000: number-average primary particle size=120 nm/solid concentration=29.9%), all the amount of "anionic surfactant solution D" and all the amount of "nonionic surfactant solution E", and the stirring process thereof was started. Next, to this was added 44.0 L of ion exchange water. The heating process was started, and when the temperature of the solution had reached 70° C., "initiator solution F" was added thereto. Then, a solution, preliminarily prepared by mixing 11.0 kg of styrene, 4.00 kg of n-butyl acrylate, 1.04 kg of methacrylic acid and 9.02 g of t-dodecyl mercaptan, was dripped thereto. After completion of the dripping process, while the temperature of the solution was controlled within 72° C.±2° C., the solution was heated and stirred for 6 hours. Further, the temperature of the solution was raised to 80° C.±2° C., and the solution was heated and stirred for 12 hours. Next, the solution was cooled to not more than 40° C., and the stirring process was stopped. The resulting solution was filtered through a pole filter; thus, the filtrate was prepared as "latex B." The resin particle in latex A had a glass transition temperature of 58° C. and a softening point of 132° C., and with respect to the molecular weight distribution, it had a weight-average molecular weight=245,000, with a weight-average particle size of 110 nm.

A solution formed by dissolving 5.36 kg of sodium chloride serving as a coagulant in 20.0 L of ion exchange water was prepared as "sodium chloride solution G." A solution formed by dissolving 1.00 g of fluorinated nonionic surfactant in 1.00 L of ion exchange water was prepared as "nonionic surfactant solution H."

To a 100-L SUS reactor equipped with a temperature sensor, a cooling tube, a nitrogen-introducing device and a monitoring device for particle size and shape were loaded 20.0 kg of latex A, 5.2 kg of latex B and 0.4 kg of colorant dispersion solution 1, prepared as described above, together with 20.0 kg of ion exchange water, and stirred. Next, this was heated to 40° C., and to this were successively added sodium chloride solution G, 6.00 kg of isopropanol (made by Kanto Kagaku) and nonionic surfactant solution H in this order. After this had been left for 10 minutes, the heating process was started so that the solution was heated to 85° C. in 60 minutes, and heated and stirred for 0.5 to 3 hours at 85° C.±2° C.; thus, the particle size was allowed to grow while being coagulated and fused. Next, to this was added 2.1 L of pure water to stop the growth of the particle size.

To a 5-L reactor equipped with a temperature sensor, a cooling tube and a monitoring device for particle size and shape was loaded 5.0 kg of the dispersion solution with fused particles prepared as described above, and this was heated and stirred for 0.5 to 15 hours at a solution temperature of 85° C.±2° C. so that a shape-controlling process was carried out. Then, the solution was cooled to not more than 40° C., and the stirring process was stopped. Next, a classifying process was carried out in the solution through a centrifugal precipitation method by using a centrifugal separator so that the solution was filtered through a sieve of 45 μm mesh; thus, this filtrate was prepared as association solution 1. Next, non-spherical particles in a wet-cake state were filtered and obtained from association solution 1 by using a nutshe. Thereafter, these non-spherical particles were washed with ion exchange water, and dried at an air-suction temperature of 60° C. by using a flash-jet dryer, and further dried at 60° C. by using a fluidized bed drying machine to obtain toner particles having a volume-average particle size of 6 μm.

To 100 parts by weight of these toner particles were added 0.5 parts by weight of hydrophobic silica fine particles having an average primary particle size of 10 nm (H-2,000: made by Wacker Co., Ltd.), 0.5 parts by weight of titanium oxide having an average primary particle size of 15 nm (STT30A: made by Titan Kogyo K.K.) and 1.0 part by weight of strontium titanate having an average primary particle size of 0.2 μm, and the mixture of these was mixed by Henschel mixer at a peripheral speed of 40 m/sec for 5 minutes, and then filtered through a sieve of 106 μm mesh to obtain a toner.

Example 15

Suspension Polymerization Method

Styrene (165 g), n-butyl acrylate (35 g), C.I. Pigment Red 57-1 (made by Fuji Shikiso K.K.), IR absorbing agent B1 (1 g), di-t-butyl salicylic acid metal compound (2 g), styrene-methacrylic acid copolymer (8 g) and paraffin wax (20 g) (mp=70° C.) were heated to 60° C., and dissolved and dispersed evenly by a TK homomixer (made by Tokushu Kika Kogyo Co., Ltd.) at 12,000 rpm. This was used as a polymerization initiator, and to this was added and dissolved 10 g of 2,2-azobis(2,4-valeronitrile) so that a polymerizable monomer composition was prepared. Next, to 710 g of ion exchange water was added 450 g of an aqueous solution of 0.1 M sodium phosphate, and to this was gradually added 68 g of 1.0 M calcium chloride while being stirred by a TK homomixer at 13,000 rpm to prepare a suspension in which tricalcium phosphate was dispersed. The above-mentioned polymerizable monomer composition was added to this suspension, and this mixture was stirred by a TK homomixer at 10,000 rpm for 20 minutes to granulate the polymerizable monomer composition. Thereafter, this was allowed to react in a reaction device at 75 to 95° C. for 5 to 15 hours. Tricalcium phosphate was dissolved and removed by hydrochloric acid and a classifying process was carried out in the solution through a centrifugal precipitation method by using a centrifugal separator. The resulting solution was filtered, washed and dried to obtain toner particles having a volume-average particle size of 6.5 μm. The toner particles had a glass transition temperature of 55° C., a softening point of 125° C., and with respect to the molecular weight distribution, it had a weight-average molecular weight of 120,000.

To 100 parts by weight of these toner particles were added 0.5 parts by weight of hydrophobic silica fine particles having an average primary particle size of 10 nm (H-2000: made by Wacker Co., Ltd.), 0.5 parts by weight of titanium oxide having an average primary particle size of 15 nm (STT30A: made by Titan Kogyo K.K.) and 1.0 part by weight of strontium titanate having an average primary particle size of 0.2 μm, and the mixture of these was mixed by Henschel mixer at a peripheral speed of 40 m/sec for 5 minutes, and then filtered through a sieve of 106 μm mesh to obtain a toner.

TABLE 3

| | Bulk Composition | | | | | | | | | | | | |
|---|---|---|---|---|---|---|---|---|---|---|---|---|---|
| | Binder Resin A | | | | IR Absorbing Agent B | | IR Absorbing Agent C | | Wax D | | Wax E | | |
| | Kind | Parts by weight | Kind | Parts by weight | Kind | Parts by weight | Kind | Parts by weight | Kind | Parts by weight | Kind | Parts by weight | Color |
| Ex. 1 | A1 | 80 | A2 | 20 | B1 | 0.3 | — | — | D1 | 2.5 | E1 | 0.5 | M |
| Ex. 2 | A3 | 80 | A2 | 20 | B1 | 0.3 | — | — | D1 | 2.5 | E1 | 0.5 | M |
| Ex. 3 | A3 | 100 | — | — | B1 | 0.3 | — | — | D1 | 2.5 | E1 | 0.5 | M |
| Ex. 4 | A1 | 80 | A2 | 20 | B1 | 0.15 | C1 | 0.15 | D1 | 2.5 | E1 | 0.5 | M |
| Ex. 5 | A1 | 80 | A2 | 20 | B1 | 0.3 | C1 | 0.3 | D1 | 2.5 | E1 | 0.5 | M |
| Ex. 6 | A1 | 80 | A2 | 20 | B1 | 0.3 | — | — | D1 | 1.5 | E1 | 0.5 | M |
| Ex. 7 | A1 | 80 | A2 | 20 | B1 | 0.3 | — | — | D1 | 2.5 | E1 | 0.5 | M |
| Ex. 8 | A1 | 80 | A2 | 20 | B1 | 0.3 | — | — | D1 | 2.5 | E1 | 0.5 | C |
| Ex. 9 | A1 | 80 | A2 | 20 | B1 | 0.3 | — | — | D1 | 2.5 | E1 | 0.5 | Y |
| Ex. 10 | A1 | 80 | A2 | 20 | B2 | 0.3 | — | — | D1 | 2.5 | E1 | 0.5 | M |
| Ex. 11 | A1 | 80 | A2 | 20 | B3 | 0.3 | — | — | D1 | 2.5 | E1 | 0.5 | M |
| Ex. 12 | A1 | 80 | A2 | 20 | B1 | 0.3 | C1 | 0.3 | D2 | 2.5 | E1 | 0.5 | M |
| Ex. 13 | A1 | 80 | A2 | 20 | B1 | 0.3 | C1 | 0.3 | D1 | 2.5 | E2 | 0.5 | M |
| Ex. 14 | Toner prepared by emulsion polymerizing coagulation method | | | | | | | | | | | | M |
| Ex. 15 | Toner prepared by suspension polymerization method | | | | | | | | | | | | M |

TABLE 4

| | Bulk Composition | | | | | | | | | | | | |
|---|---|---|---|---|---|---|---|---|---|---|---|---|---|
| | Binder Resin A | | | | IR Absorbing Agent B | | IR Absorbing Agent C | | Wax D | | Wax E | | |
| | Kind | Parts by weight | Kind | Parts by weight | Kind | Parts by weight | Kind | Parts by weight | Kind | Parts by weight | Kind | Parts by weight | Color |
| Com. Ex. 1 | A4 | 80 | A2 | 20 | B1 | 0.3 | — | — | D1 | 2.5 | E1 | 0.5 | M |
| Com. Ex. 2 | A5 | 100 | — | — | B1 | 0.3 | — | — | D1 | 2.5 | E1 | 0.5 | M |

TABLE 4-continued

| | Bulk Composition | | | | | | | | | | | | |
|---|---|---|---|---|---|---|---|---|---|---|---|---|---|
| | Binder Resin A | | | | IR Absorbing Agent B | | IR Absorbing Agent C | | Wax D | | Wax E | | |
| | Kind | Parts by weight | Kind | Parts by weight | Kind | Parts by weight | Kind | Parts by weight | Kind | Parts by weight | Kind | Parts by weight | Color |
| Com. Ex. 3 | A2 | 100 | — | — | B1 | 0.3 | — | — | D1 | 2.5 | E1 | 0.5 | M |
| Com. Ex. 4 | A1 | 100 | — | — | B1 | 0.3 | — | — | D1 | 2.5 | E1 | 0.5 | M |
| Com. Ex. 5 | A1 | 80 | A2 | 20 | B1 | 0.3 | — | — | D3 | 2.5 | E1 | 0.5 | M |

(Preparation of Carrier)

Carrier F1 (Production of Coat-Type Carrier)

To 400 ml of methylethyl ketone was dissolved 20 parts by weight of acryl-modified silicone resin KR9706 (made by Shin-Etsu Chemical Industry Co., Ltd.) to prepare a coating solution. This coating solution was sprayed on Cu—Zn-series ferrite particles having an average particle size of 50 μm by using a spiller coater (made by Okada Seiko CO., LTD.), and heated to 180° C. for 30 minutes so as to cure the coated resin; thus, a carrier coated with the acryl-modified silicone resin was prepared. The carrier bulk was taken out, pulverized by a grinder, classified through a sieve of 90 μm mesh, and this was further subjected to a magnetic-force classification to remove a low-magnetic-force component; thus, a resin-coated ferrite carrier having an average particle size of 50 μm was prepared.

Carrier F2 (Production of Binder-Type Carrier)

Polyester resin (100 parts by weight)(made by Kao Corporation: NE-1,110), 700 parts by weight of magnetic particles (Magnetite; EPT-1,000: made by Toda Kogyo Corp.) and 2 part by weight of carbon black (MOGUL-L; made by Cabot Corporation) were sufficiently mixed by Henschel mixer, and melt-kneaded by a twin screw extruder kneader which was set at 180° C. in the cylinder section and at 170° C. in the cylinder head section. Then, this kneaded matter was cooled off, coarsely pulverized by a hammer mill, and finely pulverized by a jet mill, and then classified to obtain carrier particles having a volume-average particle size of 40 μm.

<Toner Evaluation>

(Toner Physical Properties)

With respect to the toners of examples and comparative examples, tan δ and G' thereof at 120° C. as well as the average degree of roundness of toner particles were measured in accordance with the aforementioned methods.

(Heat Resistance)

After 20 g of the toner, put into a glass bottle, had been left at a high temperature of 50° C. for 24 hours, the toner was visually observed, and evaluated.

○: No toner aggregation was observed, causing no problems.

Δ: Soft aggregations slightly exist; however, these are separated with light force, causing no problems in practical use.

x: Strongly aggregated lumps exist, and these are not easily separated, causing problems in practical use.

TABLE 5

| | Physical Properties of Toner | | | | |
|---|---|---|---|---|---|
| | tan δ (120° C.) | G' (120° C.) | Average degree of Roundness | Heat Resistance | Carrier |
| Ex. 1 | 4.5 | $2.6 \times 10^2$ | 0.945 | ○ | F1 |
| Ex. 2 | 3.1 | $8.3 \times 10^2$ | 0.942 | ○ | F1 |
| Ex. 3 | 5.8 | $3.1 \times 10^3$ | 0.941 | ○ | F1 |
| Ex. 4 | 4.3 | $3.0 \times 10^2$ | 0.944 | ○ | F1 |
| Ex. 5 | 4.7 | $2.5 \times 10^2$ | 0.943 | ○ | F1 |
| Ex. 6 | 4.0 | $4.2 \times 10^2$ | 0.946 | ○ | F1 |
| Ex. 7 | 4.5 | $2.6 \times 10^2$ | 0.945 | ○ | F2 |
| Ex. 8 | 4.5 | $2.6 \times 10^2$ | 0.944 | ○ | F1 |
| Ex. 9 | 4.5 | $2.6 \times 10^2$ | 0.945 | ○ | F1 |
| Ex. 10 | 4.5 | $2.6 \times 10^2$ | 0.944 | ○ | F1 |
| Ex. 11 | 4.5 | $2.6 \times 10^2$ | 0.943 | ○ | F1 |
| Ex. 12 | 3.8 | $5.5 \times 10^2$ | 0.944 | ○ | F1 |
| Ex. 13 | 4.8 | $2.5 \times 10^2$ | 0.945 | ○ | F1 |
| Ex. 14 | 3.4 | $6.8 \times 10^2$ | 0.973 | ○ | F1 |
| Ex. 15 | 3.3 | $8.8 \times 10^2$ | 0.978 | ○ | F1 |
| Com. Ex. 1 | 1.8 | $1.0 \times 10^3$ | 0.942 | ○ | F1 |
| Com. Ex. 2 | 9.3 | $5.1 \times 10^2$ | 0.941 | ○ | F1 |
| Com. Ex. 3 | 2.1 | $3.2 \times 10^3$ | 0.942 | ○ | F1 |
| Com. Ex. 4 | 11.7 | $6.7 \times 10^1$ | 0.943 | ○ | F1 |
| Com. Ex. 5 | 6.9 | $8.2 \times 10^1$ | 0.942 | x | F1 |

<Image Evaluation>

Each of the color toners of examples and comparative examples was mixed with the carrier shown in Table 5 so as to have a specific toner mixing ratio, and mixed at a frame for 30 minutes to form a color starter. In the case of using carrier F1, the toner mixing ratio was 5 weight %, and in the case of using carrier F2, it was 7 weight %.

Experimental Examples 1 to 18

The starter was loaded to a full-color image-forming apparatus (modified to have a system speed of 200 mm/sec) having a non-contact fixing system, shown in FIG. 1, and images were formed by using continuous paper. The starter was supplied to each of the image-forming units of the toners of the respective colors. The starter was not supplied to the image-forming unit 10Bk. The fixing power of the non-contact fixing system (xenon lamp) was set to 3.5 J/cm$^2$. Here, in each of the experiments, the color starter was used so that the color toner contained in each starter forms each of combinations of magenta toner (M), cyan toner (C) and yellow toner (Y) in examples and comparative examples, shown in Table 6. Moreover, upon forming images, the amount of adhesion of toner single color was set to 5 g/m$^2$; and a multi-color image composed of a single-color image (Y, M, C), a two-color superposed image (R, G, B) (10 g/m$^2$) and a three-color superposed image (15 g/m$^2$) was formed, and each image, which contained solid images, dot images, half-tone images and character images for the respective colors in a mixed manner, was formed.

(Color Reproducibility)

Single color (Y, M, C) images and two-color superposed (R, G, B) images were observed, and classified into the following ranks:

○: Color reproducibility was good in all images;

Δ: Although color reproducibility was slightly poor in two-color superposed images, there were no problems in practical use; and x: Color reproducibility was poor in any of the images, causing problems in practical use.

(Color White Blank)

Single color (Y, M, C) images, two-color superposed (R, G, B) images and three-color superposed (15 g/m$^2$) images were observed, and classified into the following ranks:

○: No white blanks occurred in each of the images

Δ: White blanks slightly occurred in any of the images; however, there were no problems in practical use; and x: White blanks occurred in any of the images, causing problems in image quality.

(Smear-Preventive Property)

A single-color solid image was rubbed against another unused copying paper, and the stained state of the unused copy paper was observed, and classified into the following ranks:

○: No stains were found;

Δ: Although stains were slightly observed, no problems were raised in practical use (level causing no problem in practical use); and x: Stains were observed over the entire paper.

TABLE 6

| | Color starter (Toner kind) | | | Image Evaluation | | |
|---|---|---|---|---|---|---|
| | M | C | Y | Color Reproducibility | White Blank | Smear-preventive Property |
| Experimental Example 1 | Example 1 | Example 8 | Example 9 | ○ | ○ | ○ |
| Experimental Example 2 | Example 2 | Example 8 | Example 9 | ○ | ○ | ○ |
| Experimental Example 3 | Example 3 | Example 8 | Example 9 | ○ | ○ | ○ |
| Experimental Example 4 | Example 4 | Example 8 | Example 9 | ○ | ○ | ○ |
| Experimental Example 5 | Example 5 | Example 8 | Example 9 | ○ | ○ | ○ |
| Experimental Example 6 | Example 6 | Example 8 | Example 9 | ○ | ○ | ○ |
| Experimental Example 7 | Example 7 | Example 8 | Example 9 | ○ | ○ | ○ |
| Experimental Example 8 | Example 10 | Example 8 | Example 9 | ○ | ○ | ○ |
| Experimental Example 9 | Example 11 | Example 8 | Example 9 | ○ | ○ | ○ |
| Experimental Example 10 | Example 12 | Example 8 | Example 9 | ○ | ○ | ○ |
| Experimental Example 11 | Example 13 | Example 8 | Example 9 | ○ | ○ | ○ |
| Experimental Example 12 | Example 14 | Example 8 | Example 9 | ○ | ○ | ○ |
| Experimental Example 13 | Example 15 | Example 8 | Example 9 | ○ | ○ | ○ |
| Experimental Example 14 | Comparative Example 1 | Example 8 | Example 9 | x[1)] | ○ | ○ |
| Experimental Example 15 | Comparative Example 2 | Example 8 | Example 9 | ○ | x[2)] | ○ |
| Experimental Example 16 | Comparative Example 3 | Example 8 | Example 9 | x[1)] | ○ | x |
| Experimental Example 17 | Comparative Example 4 | Example 8 | Example 9 | ○ | x[2)] | ○ |
| Experimental Example 18 | Comparative Example 5 | Example 8 | Example 9 | x[1)] | ○ | ○ |

[1)]Color reproducibility was poor in two-color superposed images (R, B) containing magenta toner.
[2)]White blanks occurred in two-color superposed images (R, B) and three-color superposed images containing magenta toner.

(Black White Blanks)

<Production of Black Toner>

Upon manufacturing black toner Bk, with respect to 100 parts by weight of polyester resin A1, 8 parts by weight of carbon black (Mogul L; made by Cabot Corporation) and 1 part by weight of salicylic acid boron complex (LR151: made by JAPAN CARLIT CO., LTD.) serving as a charge-controlling agent were mixed therein, and the resulting mixture was melt-kneaded by using a twin-screw extruder kneader (PCM-30 made by Ikegai Corporation), and the resulting kneaded matter was rolled by a press roller into a thickness of 2 mm, and after having been cooled by a cooling belt, this was coarsely pulverized by a feather mill. Thereafter, the resulting matter was pulverized by using a mechanical grinding device (KTM: made by Kawasaki Heavy Industries, Ltd.), and further pulverized by a jet mill (IDS: made by Nippon Pneumatic Mfg. Co., Ltd.), and this was then classified by a rotor-type classifier (Teeplex-type classifier 100ATP: made by HOSOKAWA MICRON CORPORATION) to obtain black toner particles having a volume-average particle size of 7.2 μm. To 100 parts by weight of these toner particles were added 0.5 parts by weight of hydrophobic silica fine particles (H-2,000: made by Wacker Co., Ltd.), 0.5 parts by weight of titanium oxide (STT30A: made by Titan Kogyo K.K.) and 1.0 part by weight of strontium titanate having an average particle size of 0.2 μm, and the mixture of these was mixed by Henschel mixer at a peripheral speed of 40 m/sec for 60 seconds, and then filtered through a sieve of 90 μm mesh to obtain a black toner Bk. With respect to the black toner, the same method as that of the above-mentioned starter was used except that carrier F2 had a mixing ratio of 7% by weight with respect to the toner, thereby forming a black starter.

The same method as the above-mentioned color white blank evaluation method was used except that the black starter was used; thus, white blanks in a single color solid image (5 g/m$^2$) of the black toner were evaluated. As a result, no white blanks occurred, thereby providing superior images.

(Evaluation Methods for Various Physical Properties)

<Measuring Method for Glass Transition Point (Tg)>

A differential scanning calorimeter (DSC-200: made by Seiko Instruments Inc.) was used in which: 10 mg of a sample to be measured was precisely weighed, and this was put into an aluminum pan, while alumina was put into an aluminum pan so as to be used as reference, and was heated to 200° C. from normal temperature at a temperature-rise rate of 30° C./min, and this was then cooled, and subjected to measurements in the range of 20° C. to 120° C. at a temperature-rise rate of 10° C./min; thus, during this temperature-rise process, the shoulder value of the main heat-absorption peak in the range of 30° C. to 90° C. was defined as the glass transition point Tg.

<Measuring Method for Softening Point (Tm)>

A sample to be measured (1.0 g) was weighed, and a flow tester (CFT-500: made by Shimadzu Corporation) was used in which: measurements were made under conditions of the application of a die having a size of h 1.0 mm×Φ1.0 mm, a temperature rise rate of 3.0° C./min, a pre-heating time of 180 seconds, a load of 30 kg, and a measuring temperature range of 60 to 140° C., and the temperature at the time of the ½ flow of the above-mentioned sample was defined as the resin softening point (Tm).

<Measuring Method for Acid Value>

With respect to the acid value, 10 mg of a sample was dissolved in 50 ml of toluene, and this was titrated by a solution of N/10 potassium hydroxide/alcohol that had been preliminarily set, using an mixed indicator of 0.1% of bromo-thymol blue and phenol red; thus, the value was calculated from the amount of consumption of the solution of N/10 potassium hydride/alcohol.

<Hydroxyl Value>

With respect to the hydroxyl value, a weighed sample was treated by acetic anhydride, and an acetyl compound thus obtained was subjected to hydrolysis so that the number of mg of potassium hydroxide required for neutralizing isolated acetic acid was taken.

<Measuring Method for Number-Average Molecular Weight (Mn) and Weight-Average Molecular Weight (Mw)>

Measurements were made by using a gel permeation chromatography (807-IT Type: JASCO Corporation) in which: tetrahydrofuran serving as a carrier solvent was allowed to flow at a rate of 10 kg/cm$^3$ as a carrier solvent while the column was maintained at 40° C., and 30 mg of a sample to be measured was dissolved in 20 ml of tetrahydrofuran, and then, 0.5 mg of this solution was introduced together with the carrier solvent; thus these molecular weights were measured based upon polystyrene conversion.

The application of the color toner and the image-forming method of the present invention makes it possible to form a full-color image which has sufficient color-mixing property in full-color portions with a wider color-reproducing range, by using comparatively small fixing energy. Even in the case of forming an image including solid images, dot images, half-tone images and character images in a mixed manner, an image including black images and color images in a mixed manner and an image including mono-color portions and full-color portions with two-color or three-color superposed portions that have comparatively high amounts of toner adhesion in a mixed manner, it becomes possible to form an image having superior color reproducibility and image quality by using comparatively small fixing energy.

What is claimed is:

1. A toner comprising a binder resin, a colorant and an infrared absorbing agent, wherein tan δ (loss elastic modulus G"/storage elastic modulus G') of the toner at 120° C. is in the range of 3 to 6, the binder resin comprises a first polyester resin, or a first polyester resin and a second polyester resin, a weight ratio between the first polyester resin and the second polyester resin being in the range of 10:0 to 6:4, and glass transition points of the first and second polyester resins are in the range of 50 to 75° C.

2. The toner of claim 1, wherein a storage elastic modulus G' at 120° C. of the toner is not less than $1\times10^2$(Pa).

3. The toner of claim 1, wherein an average degree of roundness of the toner is not less than 0.940.

4. The toner of claim 1, comprising inorganic particles having an average primary particle size of 5 to 50 nm and toner particles comprising the binder resin, the colorant and the infrared absorbing agent.

5. The toner of claim 4, wherein a content of the inorganic particles is 0.2 to 3 parts by weight with respect to 100 parts by weight of toner particles.

6. The toner of claim 4, wherein the inorganic particles are hydrophobic silica and titanium oxide.

7. The toner of claim 1, wherein the first polyester resin has a weight-average molecular weight of 7,000 to 30,000 and the second polyester resin has a weight-average molecular weight of 30,000 to 250,000.

8. The toner of claim 1, wherein a softening point of the first polyester resin is in the range of 90–110° C., and a softening point of the second polyester resin is in the range of 120–150° C.

9. The toner of claim 1, wherein a content of the IR absorbing agent is set to 0.1 to 1 part by weight with respect to 100 parts by weight of the binder resin.

10. The toner of claim 1, further comprising a first wax and a second wax, the first wax having a fusing point of 62 to 95° C., and the second wax having a fusing point of 100 to 150° C.

11. The toner of claim 1, further comprising a wax, a content of the wax being 0.5 to 5 parts by weight with respect to 100 parts by weight of the binder resin.

12. The toner of claim 1, further comprising a first wax and a second wax, the first wax being a synthetic ester wax and the second wax being a polyolefin wax.

13. The toner of claim 1, further comprising strontium titanate.

14. A toner comprising a binder resin, a colorant, an infrared absorbing agent, and a first wax and a second wax, the first wax having a fusing point of 62 to 95° C., and the second wax having a fusing point of 100 to 150° C., where tan δ (loss of elastic modulus G"/storage elastic modulus G') of the toner at 120°0 C. is in the range of 3 to 6.

15. The toner of claim 14, wherein a storage elastic modulus G' at 120°0 C. of the toner is not less than $1\times10^2$(Pa).

16. The toner of claim 14, wherein an average degree of roundness of the toner is not less than 0.940.

17. The toner of claim 14, comprising inorganic particles having an average primary particle size of 5 to 50 nm and toner particles comprising the binder resin, the colorant, and the infrared absorbing agent, the first wax and the second wax, and wherein a content of the inorganic particles is 0.2 to 3 parts by weight with respect to 100 parts by weight of toner particles.

18. The toner of claim 14, wherein the binder resin comprises a first polyester resin, or a first polyester resin and a second polyester resin, a weight ratio between the first polyester resin and the second polyester resin being in the range of 10:0 to 6.4.

19. The toner of claim 18, wherein a content of the IR absorbing agent is set to 0.1 to 1 part by weight with respect to 100 parts by weight of the binder resin.

20. The toner of claim 18, wherein the first polyester resin has a weight-average molecular weight of 7,000 to 30,000 and the second polyester resin has a weight-average molecular weight of 30,000 to 250,000.

* * * * *